United States Patent [19]

Bartholic

[11] 4,309,274

[45] Jan. 5, 1982

[54] PREPARATION OF FCC CHARGE FROM RESIDUAL FRACTIONS

[75] Inventor: David B. Bartholic, Watchung, N.J.

[73] Assignee: Engelhard Minerals & Chemicals Corporation, Edison, N.J.

[21] Appl. No.: 139,043

[22] Filed: Apr. 10, 1980

Related U.S. Application Data

[63] Continuation-in-part of Ser. No. 38,928, May 14, 1979, Pat. No. 4,243,514, which is a continuation-in-part of Ser. No. 875,326, Feb. 6, 1978, abandoned.

[51] Int. Cl.[3] ..... C10G 29/16

[52] U.S. Cl. ..... 208/80; 208/91; 208/127; 208/251 R; 423/651

[58] Field of Search ..... 208/91, 299, 50, 307, 208/80, 53–55, 126–127; 423/651

[56] References Cited

U.S. PATENT DOCUMENTS

| | | | |
|---|---|---|---|
| 2,378,531 | 6/1945 | Becker | 208/91 |
| 2,462,891 | 3/1949 | Noll | 208/91 X |
| 2,472,723 | 6/1949 | Peet | 208/91 |
| 2,742,403 | 4/1956 | Nicholson et al. | 208/55 |

*Primary Examiner*—Delbert E. Gantz

*Assistant Examiner*—G. E. Schmitkons

*Attorney, Agent, or Firm*—Inez L. Moselle

[57] ABSTRACT

Residual fractions from distillation of petroleum are rendered suitable for charge to catalytic cracking by high temperature, short time contact in a decarbonizing zone with fluidizable solid particles of essentially inert character and low surface area to deposit high boiling components of the crude and metals on the fluidizable solid particles whereby Conradson Carbon values and metal content of the hydrocarbon feedstock are reduced to levels tolerable in catalytic cracking and carbon laid down on the inert fluidizable particles is burned in a burning zone separate from the decarbonizing zone. Heated inert particles are recycled at least in part to the decarbonizing zone and then to the burning zone. Additional charge of fluidizable inert solid is produced in situ in the burner on a regular or intermittent basis by spraying a slurry of a precursor of the fluidizable inert solid into the hot gases in the burner whereby the sprayed mist dries in the form of fine beads composed of inert material and the beads are cycled to the decarbonizing zone to reduce Conradson Carbon and metals content of new feedstock charge.

9 Claims, 1 Drawing Figure

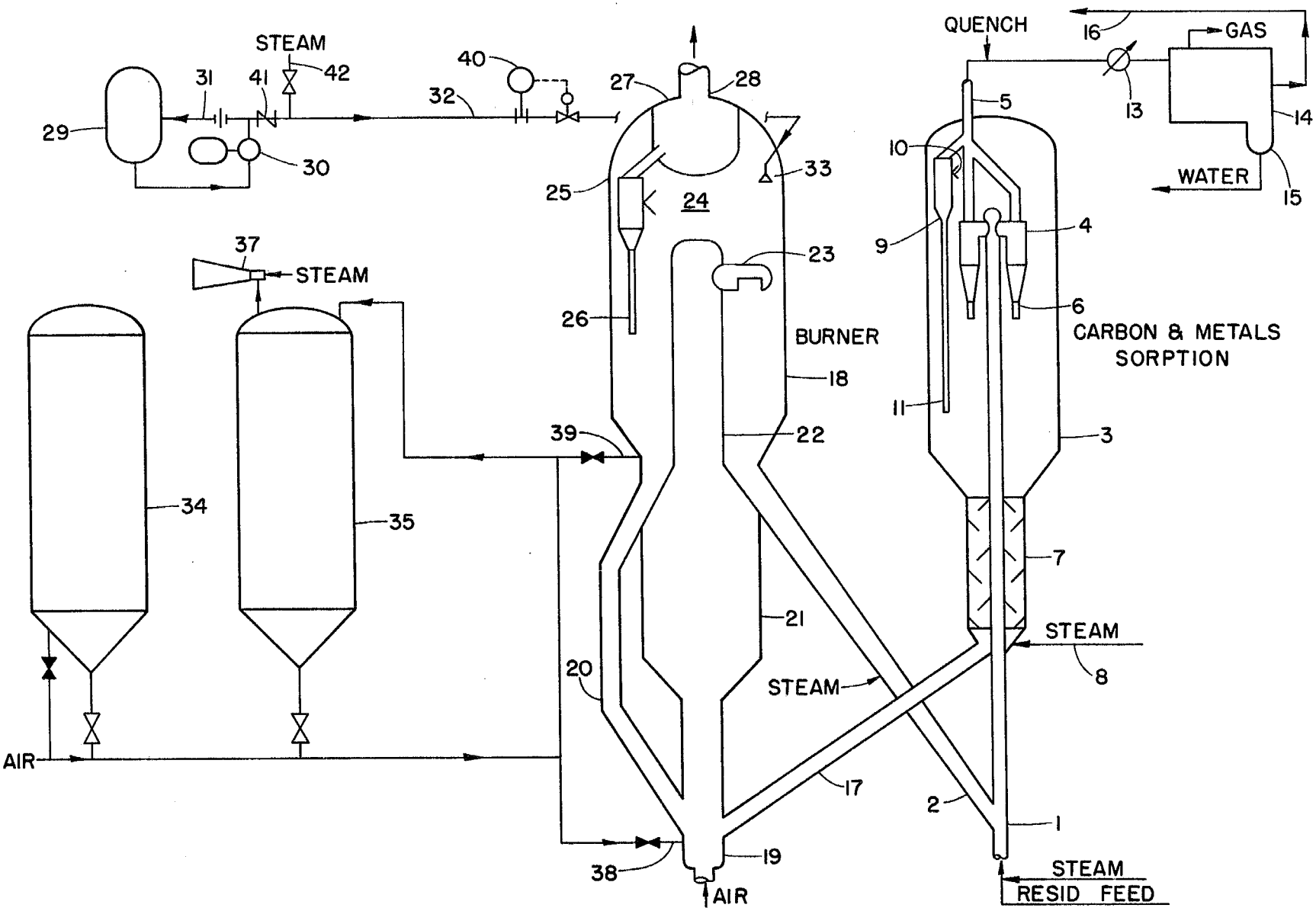
GAS
WATER
CARBON & METALS SORPTION
QUENCH
STEAM
RESID FEED
BURNER
AIR
STEAM
STEAM
STEAM
AIR

PREPARATION OF FCC CHARGE FROM RESIDUAL FRACTIONS

RELATED APPLICATION

This is a continuation-in-part of my copending application, Ser. No. 038,928 (now U.S. Pat. No. 4,243,514) dated Jan. 6, 1981 filed May 14, 1979 as a continuation-in-part of my prior application Ser. No. 875,326, filed Feb. 6, 1978, now abandoned.

BACKGROUND OF THE INVENTION

The invention is concerned with increasing the portion of heavy petroleum crudes which can be utilized as catalytic cracking feedstock to produce premium petroleum products, particularly motor gasoline of high octane number. The heavy ends of many crudes are high in Conradson Carbon and metals which are undesirable in catalytic cracking feedstocks. The present invention provides an economically attractive method for selectively removing and utilizing these undesirable components from the residues of atmospheric and vacuum distillations, commonly called atmospheric and vacuum residua or "resids." The undesirable CC (for Conradson Carbon) and metal bearing compounds present in the crude tend to be concentrated in the resids because most of them are of high boiling point. The invention provides a method for processing whole crudes high in Conradson Carbon and metals to provide feedstock for catalytic cracking.

When catalytic cracking was first introduced to the petroleum industry in the 1930's, the process constituted a major advance in its advantages over the previous technique for increasing the yield of motor gasoline from petroleum to meet a fast-growing demand for that premium product. The catalytic process produces abundant yields of high octane naptha from petroleum fractions boiling above the gasoline range, upwards of about 400° F. Catalytic cracking has been greatly improved by intensive research and development efforts and plant capacity has expanded rapidly to a present-day status in which the catalytic cracker is the dominant unit, the "workhorse" of a petroleum refinery.

As installed capacity of catalytic cracking has increased, there has been increasing pressure to charge to those units greater proportions of the crude entering the refinery. Two very effective restraints oppose that pressure, namely Conradson Carbon and metals content of the feed. As these values rise, capacity and efficiency of the catalytic cracker are adversely affected.

The effect of higher Conradson Carbon is to increase the portion of the charge converted to "coke" deposited on the catalyst. As coke builds up on the catalyst, the active surface of the catalyst is masked and rendered inactive for the desired conversion. It has been conventional to burn off the inactivating coke with air to "regenerate" the active surfaces, after which the catalyst is returned in cyclic fashion to the reaction stage for contact with and conversion of additional charge. The heat generated in the burning regeneration stage is recovered and used, at least in part, to supply heat of vaporization of the charge and endothermic heat of the cracking reaction. The regeneration stage operates under a maximum temperature limitation to avoid heat damage of the catalyst. Since the rate of coke burning is a function of temperature, it follows that any regeneration stage has a limit of coke which can be burned in unit time. As CC of the charge stock is increased, coke burning capacity becomes a bottleneck which forces reduction in the rate of charging feed to the unit. This is in addition to the disadvantage that part of the charge has been diverted to an undesirable reaction product.

Metal bearing fractions contain, inter alia, nickel and vanadium which are potent catalysts for production of coke and hydrogen. These metals, when present in the charge, are deposited on the catalyst as the molecules in which they occur are cracked and tend to build up to levels which become very troublesome. The adverse effects of increased coke are as reviewed above. The lighter ends of the cracked product, butane and lighter, are processed through fractionation equipment to separate components of value greater than fuel to furnaces, primarily propane, butane and the olefins of like carbon number. Hydrogen, being incondensible in the "gas plant," occupies space as a gas in the compression and fractionating train and can easily overload the system when excessive amounts are produced by high metal content catalyst, causing reduction in charge rate to maintain the FCC unit and auxilaries operative.

These problems have long been recognized in the art and many expedients have been proposed. Thermal conversions of resids produce large quantities of solid fuel (coke) and the pertinent processes are characterized as coking, of which two varieties are presently practiced commercially. In delayed coking, the feed is heated in a furnace and passed to large drums maintained at 780° to 840° F. During the long residence time at this temperature, the charge is converted to coke and distillate products taken off the top of the drum for recovery of "coker gasoline", "coker gas oil" and gas. The other coking process now in use employs a fluidized bed of coke in the form of small granules at about 900° to 1050° F. The resid charge undergoes conversion on the surface of the coke particles during a residence time on the order of two minutes, depositing additional coke on the surfaces of particles in the fluidized bed. Coke particles are transferred to a bed fluidized by air to burn some of the coke at temperatures upwards of 1100° F., thus heating the residual coke which is then returned to the coking vessel for conversion of additional charge.

These coking processes are known to induce extensive cracking of components which would be valuable for FCC charge, resulting in gasoline of lower octane number (from thermal cracking) than would be obtained by catalytic cracking of the same components. The gas oils produced are olefinic, containing significant amounts of diolefins which are prone to degradation to coke in furnace tubes and on cracking catalysts. It is often desirable to treat the gas oils by expensive hydrogenation techniques before charging to catalytic cracking. Coking does reduce metals and Conradson Carbon but still leaves an inferior gas oil for charge to catalytic cracking.

Catalytic charge stock may also be prepared from resids by "deasphalting" in which an asphalt precipitant such as liquid propane is mixed with the oil. Metals and Conradson Carbon are drastically reduced but at low yield of deasphalted oil.

Solvent extractions and various other techniques have been proposed for preparation of FCC charge stock from resids. Solvent extraction, in common with propane deasphalting, functions by selection on chemical type, rejecting from the charge stock the aromatic compounds which can crack to yield high octane components of cracked naptha. Low temperature, liquid phase sorption on catalytically inert silica gel is proposed by Shuman and Brace, OIL AND GAS JOURNAL, Apr. 16, 1953, page 113.

SUMMARY OF THE INVENTION

These problems of the prior art are now overcome in a process of contacting a resid or a crude oil having an appreciable Conradson Carbon (CC) content and usually a high metals content with an inert solid of low surface area at temperatures above the volumetric average boiling point of the feedstocks for very short residence times of about five seconds or less, preferably less than two seconds separating oil from the solid and quenching the oil below cracking temperature as rapidly as possible. The invention is best performed at very low contact times, say one second or less, down to about ½ second if possible. The contact temperature will generally be in the neighborhood of 900° F. and higher. The necessary short residence time is conveniently achieved by supply of the solid in a size of about 20 to 150 microns particle diameter mixed with the hydrocarbon charge in a riser. The oil is introduced at a temperature below thermal cracking temperature in admixture with steam and/or water to reduce partial pressure of volatile components of the charge. The catalytically inert solid is supplied to a rising column of charge at a temperature and in an amount such that the mixture is at a temperature upwards of 900° F. to 1050° F. and higher, sufficient to vaporize most of the charge.

At the top of the riser the solid is rapidly separated from oil vapors and the latter are quenched to temperatures at which thermal cracking is essentially arrested. During the course of this very short contact, the heavy components of high CC value containing the majority of the metal content are laid down on the solid particles. This deposition may be a coalescing of liquid droplets, adsorption, condensation or some combination of these mechanisms. In any event, there appears to be little or no conversion of a chemical nature. Particularly, thermal cracking is minimal. The quantity removed from the charge under preferred conditions is very nearly that indicated by CC of the feedstock charged. Further, the hydrogen content of the deposit on the solids is believed to be about 6%, below the 7 to 8% normal in FCC coke.

The solids, now bearing deposits of the Conradson Carbon and metals components of the hydrocarbon feedstock, are contacted with a source of oxygen, (air, for example) by any of the techniques suited to regeneration of FCC catalyst, preferably under conditions of full CO combustion to less than 1000 p.p.m. CO in the flue gas. Combustion of the deposited material from the inert solids generates the heat required in the contacting step when the combusted inert solid is recycled to the riser for subsequent contact with new charge of hydrocarbon feedstock in the contactor. During repeated cycling between the contactor and burner, portions of inert solid are removed from the system and replaced with fresh inert solid in order to maintain a suitable level of metals on the solid while it is in the contactor. Replacement of all or part of the inert fluidizable solid for subsequent contact with incoming feedstock charge to the contactor is provided in accordance with the invention by utilizing heat in the burner to form the fluidizable particles in situ. This is preferably accomplished by spraying a slurry of a precursor of the inert solid directly into the hot gases in the upper dilute hot gaseous phase of a burner operated with a lower dense phase in a manner such that sprayed material is dried by the hot gases in the burner to form fine beads (microspheres) of inert solid of low surface area.

DESCRIPTION OF THE DRAWING

A system for preparing in situ the inert solid used in a fluidized residual oil treating unit whose purpose is to remove high boiling components of the crude on the inert solid whereby Conradson Carbon (CC) values and metal content are reduced to levels tolerable in catalytic cracking is shown in the single FIGURE of the annexed drawing.

DESCRIPTION OF PREFERRED EMBODIMENTS

The decarbonizing, demetallizing step which characterizes the present invention is preferably conducted in a contactor very similar in construction and operation to riser reactors employed in modern FCC units. Hydrocarbon feedstock high in Conradson Carbon, typically a resid feed, either a vacuum resid boiling above 900° F. or an atmospheric resid which may contain components boiling as low as 500° F., is introduced to the lower end of a vertical conduit. Whole crude oils high in CC may also be employed in the process. Steam and/or water in amounts to substantially decrease hydrocarbon partial pressure is added with the feedstock. Pressures will be sufficient to overcome pressure drops, say 15 to 50 p.s.i.a. The charge may be preheated in a furnace, not shown, before introduction to the riser contactor, to any desired degree below thermal cracking temperature, e.g., 200° to 800° F., preferably 300° to 700° F. Higher temperatures will induce thermal cracking of the feed with production of low octane naptha.

The feed diluted by steam rises in the contactor 1 at high velocity such as 40 feet per second. Hot inert solid in finely divided form is introduced to the feed from a standpipe 2 in a quantity and at a temperature to provide a mixture at a temperature in excess of 900° F. to volatilize all components of the feed except the very heavy compounds of high CC and high metal content.

The solid contacting agent is essentially inert in the sense that it induces minimal cracking of heavy hydrocarbons by the standard microactivity test conducted by measurement of amount of gas oil converted to gas, gasoline and coke by contact with the solid in a fixed bed. Charge in that test is 0.8 grams of mid-Continent gas oil of 27° API contacted with 4 grams of catalyst during 48 second oil delivery time at 910° F. This results in a catalyst to oil ratio of 5 at weight hourly space velocity (WHSV) of 15. By that test, the solid here employed exhibits a microactivity less than 20, preferably about 10. A preferred solid is microspheres of calcined kaolin clay. Other solids include low surface area forms of silica gel and bauxite.

During initial start-up of the decarbonizing contactor, an available charge of low surface area inert solid is used. Surface area is below 100 $m^2/g$ (BET using nitrogen absorption), preferably below about 50 $m^2/g$, and most preferably below about 25 $m^2/g$. For example, microspheres of calcined clay may be employed. These microspheres may be obtained from a commercial source and used for start-up of the contactor/burner system of the invention or they can be produced by spray drying an aqueous suspension of hydrated clay, preferably fine particle size kaolin clay, to produce microspheres and then calcining the microspheres at temperatures in the range of about 1600° F. to 2100° F. Reference is made to U.S. Pat. No. 3,647,718 to Haden et al. for details of preparation of suitable microspheres from hydrated kaolin clay, noting that in the patent such microspheres are used as a reactant with caustic to form high surface zeolite in situ, whereas in the present invention the microspheres are used in low surface area form and they do not undergo zeolite crystallization which would undesirably increase surface area and contribute unwanted catalytic activity. Typically the calcined clay microspheres have a surface area below about 15 $m^2/g$ and analyze about 51% to 53% (wt.) $SiO_2$, 41 to 45% $Al_2O_3$, and from 0 to 1% $H_2O$, the balance being minor amounts of indigenous impurities, notably iron, titanium and alkaline earth metals. Generally iron content (expressed as $Fe_2O_3$) is about ½% by weight and titanium (expressed as $TiO_2$ is approximately 2%).

Other solids of low catalytic activity may be employed. Examples are: rutile, low surface area forms of alumina, magnesium oxide, sillimanite, andalusite, pumice, mullite, calcined coleminite, feldspar, fluorspar, bauxite, barytes, chromite, zircon, magnesite, nepheline, syenite, olivine, wollastonite, manganese ore, ilmenite, pyrophyllite, talc (calcined fosterite), calcined dolomite, calcined lime, low surface area silica (e.g., quartz), perlite, slate, anhydrite, coke and iron oxide ore. In general, solids of low cost are recommended since it will usually be necessary to discard a sizeable portion of the contact agent in the system from time to time and replace it with fresh agent to maintain a suitable level of metals. Since the solid is preferably of low porosity, resulting in deposition primarily on external surfaces, the invention contemplates abrading the particles as in a column of air at velocity to permit refluxing of solids for removal of external metal deposits with optional recycle of portions of metal-depleted abraded particles in the system. Typically inert fluidizable particles used for start-up have a diameter in the range of 20 to 150 microns. The surface area of the inert solid particles is usually within the range of 10 to 15 $m^2/g$. It is noted that the surface areas of commercial fluid zeolite catalysts is considerably higher, generally exceeding values of 100 $m^2/g$. as measured by the B.E.T. method.

Length of the riser contactor 1 is such as to provide a very short time of contact between the feed and the contacting agent, less than 2 seconds, preferably 0.5 seconds or less. The contact time should be long enough to provide good uniformity of contact between feed and contacting agent, say at least 0.1 second.

At the top of the riser, e.g., 15 to 20 feet above the point of introduction of contacting agent from standpipe 2 at a feed velocity of 40 feet per second, vaporized hydrocarbons are separated as rapidly as possible from particulate solids bearing the high CC deposits and metals. This may be accomplished by discharge from the riser into a large disengaging zone defined by vessel 3. However, it is preferred that the riser vapors discharge directly into cyclone separators 4 from which vapors are transferred to vapor line 5 while entrained solids drop into the disengaging zone by diplegs 6 to stripper 7 where steam admitted by line 8 evaporates traces of volatile hydrocarbons from the solids. The mixture of steam and hydrocarbons, together with entrained solids, enters cyclone 9 by mouth 10 to disengage the suspended solids for return to stripper 7 by dipleg 11. As well known in the fluid cracking art, there may be a plurality of cyclones 4 and cyclones 9 and the cyclones may be multistage, with gas phase from a first stage cyclone discharging to a second stage cyclone.

In one embodiment, the cyclones 4 may be of the stripper cyclone type described in U.S. Pat. No. 4,043,899, the entire disclosure of which is hereby incorporated by this reference. In such case the stripping steam admitted to the cyclone may be at a low temperature, say 400° to 500° F., and serve to perform part or all of the quenching function presently to be described.

The vaporized hydrocarbons from cyclones 4 and 10 passing by way of line 5 are then mixed with cold hydrocarbon liquid introduced by line 12 to quench thermal cracking. The quenched product is cooled in condenser 13 and passed to accumulator 14 from which gases are removed for fuel and water is taken from sump 15, preferably for recycle to the contactor for generation of steam to be used as an aid in vaporizing charge at the bottom of the riser and/or removing heat from the burner. Condenser 13 is advantageously set up as a heat exchanger to preheat charge to the contactor or preheat charge to the FCC unit hereinafter described and the like.

In one embodiment, the quenching is advantageously conducted in a column equipped with vapor-liquid contact zones such as disc and doughnut trays and valve trays. Bottoms from such column quencher could go directly to catalytic cracking with overhead passing to condenser 13 and accumulator 14.

The liquid hydrocarbon phase from accumulator 14 is a decarbonized and demetallized resid fraction which is now satisfactory charge for catalytic cracking. This product of contact in riser 1 may be used in part as the quench liquid at line 12. The balance is preferably transferred directly to a catalytic cracker by line 16.

Returning now to stripper 7, the inert solid particle bearing a deposit of high CC and metallic compounds passes by a standpipe 17 to the inlet of burner 18. Standpipe 17 discharges to a riser inlet 19 of burner 18 where it meets a rising column of air introduced by line 19 and is mixed with hot inert particles from burner recycle 20 whereby the mixture is rapidly raised to a temperature for combustion of the deposits from treating resid, 1150° to 1500° F. The mixture enters an enlarged zone 21 to form a small fluidized bed for thorough mixing and initial burning of deposits. The flowing stream of air carries the burning mass through a restricted riser 22 to discharge at 23 into an enlarged disengaging zone. The hot, burned particles, now largely free of combustible deposit, fall to the bottom of the disengaging zone from which a part enters recycle 20 and another part enters the standpipe 2 for supply to contactor 1 after steam stripping. By reason of the very high temperatures attainable in this type of burner and in the presence of a stoichiometric excess of oxygen, CO will burn to provide a flue gas containing very little of that gas. In other types of burners, the combustion products may contain substantial amounts of CO which can be burned for its heating value in CO boilers of the type commonly used in FCC units.

At such time that the metals level of the inert solid becomes excessive and spent inert solid must be withdrawn to maintain metals at an acceptable level and/or in response to the need for additional inert solid because of increased Conradson Carbon in incoming-feedstock, additional inert must be added to the system. This is accomplished by spray drying a slurry of precursor of low surface area inert particles into the upper (dilute) phase of the burner by selection of the proper spray nozzle to obtain beads of the particle size desired which is typically predominantly in the size range of 20 to 150 microns. A slurry or suspension, preferably one based on an aqueous vehicle, is sprayed near the top of the burner into an atomizer spinning at high speed. This distributes the slurry into fine droplets throughout the upper interior portion of the burner. The droplets contact an upflowing current of hot gases produced by the combustion of carbonaceous deposit on inert solid in the bottom of the burner. The mist dries in the form of fine beads.

To facilitate in situ spray drying, it may be advantageous to disperse the feed slurry by incorporating a suitable dispersing agent into the slurry before it is sprayed. In the case of aqueous slurries of clay a polyanionic salt dispersant such as sodium silicate or a sodium condensed phosphate salt (e.g., tetrasodium pyrophosphate) is recommended. By employing a dispersant (deflocculating agent), the slurry may be produced at high solids levels and harder fluidizable particles are usually obtained when the higher solids content slurries are sprayed into the burner. When a deflocculating agent is employed with the preferred kaolin clay, slurries containing about 55 to 60% solids may be prepared. These high solids slurries are preferred to the 40 to 50% slurries which do not contain a deflocculating agent. Several procedures can be followed in mixing the ingredients to form the slurry. One procedure, by way of example, is to add water to a finely divided solid precursor and then incorporate the deflocculating agent. The components can be mechanically worked together or individually to produce slurries of viscosity characteristics conducive to appropriate operation of the spray nozzles.

Referring now to the annexed drawing, feed slurry containing precursor of inert solid is transferred to tank 29 and kept mixed by pump 30 discharging through restriction orifice 31 to tank 29 through a jet nozzle (not shown) to induce mixing of the contents of the tank. When additional inert solid is needed for operation of the contactor, slurry from tank 29 is discharged through Flow Recorder Controller (FRC) 40 located in line 32 and pumped through spray nozzle 33 into the dilute phase 24 of burner 18. In normal operation, flow of slurry from tank 29 through nozzle 33 into burner 18 will be continuous as soon as the system has been started up and combustion of deposited carbonaceous material in burner 18 has been initiated. In those operations in which additional inert solid is generated in situ on an intermittent basis and line 32 is not in operation, line 32 will be continuously purged with steam through line 42. Steam is restrained from flowing into pump 30 discharge by check valves 41 so that all the steam injected into line 32 flows through FRC-40 to spray nozzle 33 and into the dilute phase 24 of burner 18.

The rate of slurry pumped into burner 18 through the above described system is controlled to form new microspheres so that the total metals level on the circulating microspheres inventory is maintained below the level at which the metals produce undesirable reactions with the hydrocarbon feed in contactor 1. Normally this will be from 0.5 to 5 weight % metals but preferably around 2 weight % on the circulating inventory.

As the level or quantity or microspheres increases in the unit because of the addition of new spray dried material being injected as described above, equilibrium microspheres can be withdrawn through either line 38 or line 39 into the equilibrium inert storage hopper 35. Withdrawal of microspheres is accomplished by using steam ejector 37 to lower the pressure on storage hopper 35 and opening up either line 38 or line 39. The pressure differential between the operating pressure of the burner 18 and the vacuum of the storage hopper 35 provides the driving force for flow of microspheres from burner 18 to storage hopper 35. Gases entrained with the microspheres are removed through ejector 37 and the degassed microspheres settle to the bottom of storage hopper 35. Fresh microsphere storage hopper 34 is provided for adding microspheres manufactured off site.

As the slurry is pumped through spray nozzle 33 into the dilute phase 24 of burner 18, there is countercurrent flow of slurry and hot flue gases which are employed to dry the microspheres.

The flue gas is a result of the introduction of air into burner 18 through riser inlet 19 as explained above. In other types of burners, the combustion products may contain substantial amounts of CO which can be burned for its heating value in CO boilers of the type commonly used in FCC units.

In the type of burner shown, the gaseous products of combustion at 1200° F., containing carbon dioxide, some residual oxygen, nitrogen, oxides of sulfur and perhaps a trace of CO are the flue gas used to provide the heat necessary in the spray drying of the slurry.

In a typical residual unit using 1 pound of inert per barrel of fresh feed and producing 7 weight % coke, and burning all the CO to $CO_2$ with a burner discharge 23 outlet of 1400° F., the continuous injection of a 60% solids aqueous slurry of hydrated kaolin clay will reduce the temperature of the gases entering cyclones 25, 5° to 10° F.

At these temperatures, free moisture is removed from the slurry and water of hydration (water of crystallization) is also removed from the raw clay ingredient. Typically the majority of particles produced have a diameter in the range of 20 to 150 microns and are calcined at 1200° F. to 1400° F. by adding the spray dried particles to the burner as described above thereby converting the clay into the material known as "metakaolin".

Other solids of low catalytic activity, low surface area (below about 100 $m^2/g$, preferably below about 50 $m^2/g$) and most preferably below above 25 $m^2/g$, and of like particle size may be generated in situ as described above. The preferred precursor is hydrated clay, most preferably hydrated kaolin clay. Exemplary of other precursors which are convertible to low surface area beads by spray drying into hot combustion gases are coleminate, magnesite, fosterite, dolomite and lime. Precursors which have low surface area before spraying into the hot gases include rutile, selected forms of alumina, magnesia, sillimanite and other materials listed above for use in start-up. Generally the particles of the precursors are finer than 325 mesh when formed into slurries for spraying into the burner. In general, solids of low cost are recommended since as mentioned it may be desirable to discard a sizeable portion of the contact agent in the system from time to time and replace it with fresh agent to maintain a suitable level of metals.

Flue gas from outlet 23 and water vapor produced during drying of the slurry injected through spray nozzle 33 exit burner 18 through cyclones 25 (one of a plurality of such devices) to disengage entrained solids for discharge by dipleg 26. The clarified gases pass to plenum 27 from which flue gas is removed by outlet 28.

Although the system just described bears superficial resemblance to an FCC unit, its operation is very different lfrom FCC. Most importantly, the riser contactor 1 is operated to remove from the charge an amount not greatly in excess of the Conradson Carbon Number of the feed. This contrasts with normal FCC "conversion" of 50 to 70%, measured as the percentage of FCC product not boiling within the range of the charge. Percent removed by the present process is preferably on the order of 10 to 20% on charge and constituted by gas, and deposit on the solid contacting agent. Rarely will the amount removed from boiling range of the charge exceed a value, by weight, more than three to five times the Conradson Carbon value of the charge. This result is achieved by a very low severity of cracking due to inert character of the solid and the very short residence time at cracking temperature. As is well known, cracking severity is a function of time and temperature. Increased temperature may be compensated by reduced residence time and vice versa.

The new process affords a control aspect not available to FCC units in the supply of steam to the riser contactor. When processing stocks of high CC, the burner temperature will tend to rise because of increased supply of fuel to the burner. This may be compensated by increased quantity, decreased temperature or increasing the steam supplied to reduce partial pressure of hydrocarbons in the riser contactor or recycling water from the overhead receiver to be vaporized in the riser to produce steam.

The water so added, whether fresh or recycled in the system, is advantageously emulsified in the charge or in a portion of the charge which is then mixed with the main body of the charge before introduction to the system. When liquid water as the internal phase of a water and oil emulsion is rapidly heated to temperatures far above the boiling point of water, the water vaporizes with explosive violence to atomize the oil surrounding the emulsified water globules and thus promote dispersion and vaporization of the oil charge.

Vaporization can be further promoted by recycle of hydrocarbons lighter than the heavy end of the charge, say a fraction boiling above 100° F. and below about 1050° F. which may be derived from fractionation of the decarbonized product, by fractionation of FCC reactor effluent or other suitable source.

Means are known for introduction of the charge to FCC reactors in a manner to promote prompt and intimate contact of charge with fluidizable solids at the bottom of a riser. The purposes of this invention are well served by these devices. A particularly attractive device of this type is the multiple nozzle injector described in U.S. Pat. No. 4,149,964, granted Apr. 17, 1979.

The riser contact with inert solid thus provides a novel sorption technique for removing the polynuclear aromatic compounds of resids (high CC and metals) while these are carried in a stream of low hydrocarbon partial pressure by reason of steam supplied to the riser.

The decarbonized, demetallized resid is good quality hydrotreating, hydrocracking or FCC charge stock and may be transferred to the feed line of an FCC reactor (not shown) operated in the conventional manner. Hot regenerated catalyst is transferred from an FCC regenerator (not shown) by a standpipe for addition to the reactor charge. Spent catalyst from the FCC reactor passes by a standpipe to a conventional FCC while cracked products leave reactor by transfer line to fractionation (not shown) for recovery of gasoline and other conversion products.

EXAMPLES

The effect of contacting in the manner described above has been demonstrated in laboratory scale equipment. The apparatus employed is a circulating fluidized bed pilot plant which simulates behavior of commercial FCC riser reactors. The reactor is equipped to provide a stream of nitrogen through the riser and for addition of catalyst and charge. The riser is lagged and heated to maintain isothermal conditions. The nitrogen flow serves the same function as the steam described above for reduction in partial pressure of hydrocarbons. In the runs described below residual stocks and the microspheres set forth above were contacted under the conditions recited. Inspection data on the charge stock are given in Table 1.

TABLE I

DESCRIPTION OF CHARGE STOCKS

| Example | 1 | 2 |
|---|---|---|
| Gravity, °API | 27.9 | 23 |
| Ramsbottom Carbon, % | 0.35 | 2.5 |
| Metals, p.p.m. | | |
| Ni | 1 | 10 |
| Cu | 1 | 1 |
| V | 1 | 20 |
| Distillation, °F. | | |
| IBP | 438 | 420 |
| 10% | 554 | 478 |
| 30% | 659 | 711 |
| 50% | 750 | 829 |
| 70% | 847 | 979 |
| 76% | — | 1046 |
| 90% | 991 | — |
| 94% | 1050 | — |

Feedstock 1 is a typical mid-continent FCCU feed where Feedstock #2 is a blend of #1 and Cenex atmospheric bottoms. This Cenex feed is processed commercially in a vaccum unit where 55 vol.% is yielded as FCC feed and the other 45 vol.% as asphalt. In order to produce a pitch material, the asphalt can be processed in a propane deasphalter where 50 vol.% of the asphalt is yielded as pitch and the other 50 vol.% burned as fuel oil in the refinery.

Conditions of contact and resultant products are shown in Table II.

TABLE II

CONTACT CONDITIONS AND PRODUCTS

| Example | 1 | 2 |
|---|---|---|
| Rise contactor temp., °F. | 915 | 935 |
| Contact time, seconds | 0.66 | 0.97 |
| Contact solid temp., °F. | 1203 | 1185 |
| Oil partial pressure, p.s.i.a. | 2.83 | 4.62 |
| Oil preheat temp., °F. | 641 | 659 |
| Solids/oil, wt. | 12.5 | 12.2 |
| Mol ratio, $N_2$/oil | 3.7 | 2.2 |
| Products, wt. % | | |
| Gas | 7.9 | 7.6 |
| Liquid | 90.4 | 85.5 |
| Deposit on solid | 1.7 | 6.9 |
| Liquid Product | | |
| Metals, p.p.m. | | |
| Ni | — | 1.5 |
| Cu | — | 1.0 |
| V | — | 1.0 |
| Ramsbottom Carbon | — | 0.6 |
| Distillation, °F. | | |
| IBP | 170 | 173 |
| 10% | 466 | 475 |
| 30% | 597 | 610 |

TABLE II-continued

| CONTACT CONDITIONS AND PRODUCTS | | |
|---|---|---|
| Example | 1 | 2 |
| 50% | 684 | 704 |
| 70% | 775 | 803 |
| 90% | 894 | 967 |
| 93% | — | 1033 |
| EP | 1028 | — |

I claim:

1. A process for upgrading a petroleum charge of a crude oil or a residual fraction thereof which contains high boiling components of substantial Conradson Carbon number which comprises emulsifying water in said charge as the internal phase of a water in oil emulsion, contacting the emulsion of water in said charge in a confined rising vertical column with a finely divided solid contact material consisting essentially of an inert solid material having a microactivity for catalytic cracking not substantially greater than 20 at low severity, including a temperature of at least about 900° F. for a period of time less than 2 seconds and less than that which induces substantial thermal cracking of said charge, at the end of said period of time separating from said inert solid a decarbonized hydrocarbon fraction of reduced Conradson Carbon number as compared with said charge and reducing temperature of said separated fraction to a level below that at which substantial thermal cracking takes place to terminate said period of time.

2. The process according to claim 1 wherein said feedstock is a residual fraction of petroleum obtained by fractionally distilling a crude petroleum to separate distillates from the residual fraction thus produced.

3. The process of claim 1 wherein said inert solid has a B.E.T. surface area below about 100 $m^2/g$.

4. The process of claim 1 wherein said inert solid has a B.E.T. surface area below about 15 $M^2/g$.

5. The process of claim 1 wherein said inert solid comprises thermally dehydrated clay.

6. In a process for preparing premium products from crude petroleum by fractionally distilling the crude petroleum to separate gasoline and distillate gas oil from a residual fraction having a substantial Conradson Carbon number and metals content and charging the distillate gas oil to catalytic cracking; the improvement which comprises;

(a) emulsifying liquid water in said residual fraction and contacting the resultant emulsion in a rising confined vertical column with an inert solid material having a low surface area and a microactivity for catalytic cracking not substantially greater than 20 at low severity, including a temperature of at least about 900° F., for a period of time less than that which induces substantial thermal cracking of said residual fraction, and such that the quantity of such decarbonized petroleum fraction is less than said residual fraction by a weight percent no greater than three times said Conradson Carbon number, (b) at the end of said period of time separating from said inert solid a decarbonized hydrocarbon fraction of reduced Conradson Carbon number and metals content as compared with said residual fraction, (c) reducing temperature of the said separated fraction to a level below that at which substantial thermal cracking takes place, (d) adding said decarbonized hydrocarbon to said distillate gas oil as additional charge to said catalytic cracking, (e) subjecting said inert solid separated from said decarbonized hydrocarbon fraction and now containing a combustible deposit to air at elevated temperature to remove said combustible deposit by burning and thereby heat the inert solid in a burner, (f) separating heated inert solids from hot vapors produced in step (e), and (g) cycling at least a portion of said separated hot inert solid from steps (e) to step (a).

7. The process of claim 6 wherein said separated heated inert solids from step (f) are recycled while still hot into contact with further charge of emulsified residual fraction in step (a).

8. The process of claim 6 wherein said inert solid comprises thermally dehydrated clay.

9. In a process for preparing premium products from crude petroleum by fractionally distilling the crude petroleum to separate gasoline and distillate gas oil from a residual fraction having a substantial Conradson Carbon number and metals contact and charging the distillate gas oil to catalytic cracking the improvement which comprises:

(a) emulsifying liquid water in said residual fraction and contacting the resultant emulsion in a rising confined vertical column with fluidizable particles of thermally dehydrated clay which are catalytically inert or substantially so under conditions of elevated temperature and short contact time such as to avoid substantial thermal cracking of said residual fraction and selectively vaporize hydrocarbons and deposit hydrocarbons contributing to Conradson Carbon number on said fluidizable particles, (b) at the end of said period of time separating from said particles of calcined clay now having a deposit of hydrocarbon and metals from a decarbonized hydrocarbon fraction of reduced Conradson Carbon number as compared with said residual fraction, (c) reducing temperature of the separated hydrocarbon fraction to a level below that at which substantial thermal cracking takes place, (d) adding said decarbonized hydrocarbon to said distillate gas oil as additional charge to said catalytic cracking, (e) burning combustibles from said particles of thermally dehydrated clay in a burner to thereby heat the inert solid, (f) separating hot gases from the burning of combustibles from hot inert solids in said burner, and (g) recycling at least a portion of said hot inert solids into contact with further charge of said emulsified residual fraction.

* * * * *